US006517342B2

(12) United States Patent
van der Veen

(10) Patent No.: US 6,517,342 B2
(45) Date of Patent: Feb. 11, 2003

(54) DEVICE FOR IGNITING FUEL

(75) Inventor: Geuko van der Veen, Deventer (NL)

(73) Assignee: Gastec N.V., Apeldoorn (NL)

( * ) Notice: Subject to any disclaimer, the term of this patent is extended or adjusted under 35 U.S.C. 154(b) by 0 days.

(21) Appl. No.: 09/764,519

(22) Filed: Jan. 18, 2001

(65) Prior Publication Data

US 2001/0021495 A1 Sep. 13, 2001

(30) Foreign Application Priority Data

Jan. 19, 2000 (NL) ..... 1014119

(51) Int. Cl.[7] ..... F23N 5/00

(52) U.S. Cl. ..... 431/72; 431/89; 200/83 A; 200/83 Q; 137/503; 251/63.4

(58) Field of Search ..... 431/72, 18, 60, 431/61, 62, 255, 89, 46; 200/61.86, 83 A, 83 R, 83 F, 83 Q; 137/111, 119, 503; 251/30.02, 61.3, 63.4; 236/1 E

(56) References Cited

U.S. PATENT DOCUMENTS 3,562,562 A 2/1971 Kreuter ..... 310/8.3
3,676,041 A * 7/1972 Mobus ..... 431/72
4,242,082 A * 12/1980 Branson et al. ..... 431/72
4,346,835 A * 8/1982 Trotter et al. ..... 431/255
4,717,333 A * 1/1988 Carignan ..... 431/69

FOREIGN PATENT DOCUMENTS

GB 2 099 130 A 12/1982

* cited by examiner

*Primary Examiner*—James C. Yeung
(74) *Attorney, Agent, or Firm*—Weingarten, Schurgin, Gagnebin & Hayes LLP

(57) ABSTRACT

A device for igniting fuel, comprising at least one burner, the device comprising ignition means comprising an ignition element, the ignition means further comprising a movable element which is connected to a fluid line, such that a fluid contained in the fluid line, when it flows, creates a pressure difference across the movable element, as a result of which the movable element is set in motion, the movable element being connected with the ignition element, such that the movement of the movable element generates via the ignition element and ignition temperature by means of which the fuel is caused to combust.

13 Claims, 4 Drawing Sheets

DEVICE FOR IGNITING FUEL

BACKGROUND OF THE INVENTION

This invention relates to a device for igniting fuel, comprising at least one burner, the device being fitted with ignition means. Such devices are used, for instance, in gas-fired heaters and heating boilers for CH systems. In reflector heaters in stables for breeding chickens or other animals, the ignition means are often absent. Such heating systems are often provided with a large number of burners, for instance to keep a large space at a uniformly distributed, constant temperature. Especially in that case, igniting all burners is a very serious problem.

A frequently used method to ignite a plurality of burners is to ignite each burner by hand. That is a highly time consuming job, so that, in view of the high labor costs involved, this is an expensive solution. Therefore, the burners, once they have been ignited by hand, are mostly set in a lowest operative mode in the periods that there is no heat requirement. This obviates the burners having to be re-ignited every time when the use of the burners is desired again. Keeping the burners in a lowest operative mode is cheap with regard to the labor costs, but expensive with regard to fuel consumption. Moreover, in the lowest operative mode of the burners, relatively much carbon monoxide is produced, which is harmful to animals or humans that are in the space to be heated.

One solution is to provide each burner with centrally controllable electronic ignition means. This has two disadvantages. In the first place, such a device depends on a power supply. If this power supply fails, this means that a burner which has gone out for whatever reason cannot be ignited anymore. This can inflict great damage in, for instance, a stable for breeding animals, where it is of vital importance that heat be available continuously to keep the temperature in the space constant. In the second place, this electronic solution is expensive because of the technically complicated measures it entails.

SUMMARY OF THE INVENTION

The present invention contemplates solving these problems. That is, the invention contemplates a device for igniting fuel, wherein the ignition means can ignite the burner without this requiring external electric energy to be supplied.

To that end, the invention provides a device of the type described in the preamble, which is characterized in that the ignition means comprise a movable element which is connected to a fluid line, such that a fluid contained in the fluid line, when it flows, creates a pressure difference across the movable element, as a result of which the movable element is set in motion, the movable element being connected with the ignition element, such that the movement of the movable element generates via the ignition element an ignition temperature by means of which the fuel is caused to combust, the fluid line being either a fuel line for the purpose of the supply of fuel to the at least one burner, or a fluid line through which flows a fluid to be heated by means of the at least one burner.

With such a device, therefore, a burner can be ignited by means of a movement which is generated by the kinetic energy of the fluid flowing. Accordingly, as soon as the fluid starts to flow, so that the movable element is energized, ignition of the burner will be effected. Accordingly, there is no necessity for supplying power to the device to ignite the burner. In the application involving the heating of stables, where a large number of burners are present, the connected burners can be readily ignited simultaneously by turning on the central gas inlet cock. The combustible gas then forms the fluid setting the movable element in motion.

According to a further elaboration of the invention, the ignition means comprise valve means and spring means which exert an oppositely directed spring force on the movable element with respect to the force as a result of the pressure difference, while in an opened position of the valve means the pressure difference across the movable element is smaller than in a closed position, while in said closed position the spring force is smaller than the force as a result of the pressure difference, while in the opened position of the valve means the spring force is greater than the force as a result of the pressure difference, such that upon a periodic alternation of the position of the valve means between the first and the second position, the movement of the movable element repeats itself.

The repetitive movement of the movable element provides repetitive attempts of the ignition means to ignite fuel in the burner or in an ignition burner that may be present. Such repetition of the ignition may be necessary when the first ignition attempt has failed, for instance in that fuel has flowed in too small an amount, or not far enough yet, into the burner, the optional ignition burner or a combustion chamber, and hence has not been ignited yet.

Preferably, the burner is provided with deactivation means which , when the fuel has been ignited or is burning, reduce the pressure difference across the movable element, such that the movable element stops moving. The reason is that it is not necessary for the ignition attempts to be repeated when the burner has already been ignited.

It is therefor recommended that the at least one burner is provided with a protection which, as a result of a termination of the combustion, shuts off a burner line through closing means, such that no fuel flows into the at least one burner, the protection being coupled to the ignition means, such that closing the burner line is accompanied by the development of a pressure difference across the movable element as a result of which the movable element is set in motion. Thus the protection prevents fuel, subsequent to the burner flame becoming erroneously extinguished, from leaving the burner unburned, thereby giving rise to a possibly explosion-dangerous situation in the space in which the burner is set up. Due to the protection setting the movable element in motion by creating the pressure difference of the fluid, the ignition means are activated. As a result, the extinguished burner will automatically be ignited again. Obviously, these ignition attempts no longer take place when the supply of fluid has been stopped, so that no flow of fluid across the movable element takes place anymore.

Preferably, the movable element is coupled to the closing means, such that as a result of the movement of the movable element the closing means are opened when the movement of the movable element generates the ignition temperature via the ignition element, so that fuel flows into the at least one burner. This guarantees that fuel flows into the burner at the moment of an ignition attempt.

According to a further elaboration of the invention, the ignition means comprise an ignition burner which, for instance, is ignited with a piezo element, a flint or a spark which is generated with a generator such as is present in a dyno torch. The piezo element, the flint or the generator in their turn are energized by the movable element. Once this ignition burner burns, the gas supply of the burner is subsequently activated. This can be effected in the same manner as in the conventional gas heaters, whereby with the aid of a thermocouple a gas valve is opened in the gas supply line of the burner. Such a thermocouple is set up in the flame of the ignition burner and generates a small current by means of which the valve referred to is operated. According to a further elaboration of the invention, it is preferred that the closing means also shut off the burner line for the ignition burner when the burner is extinguished for one reason or another.

In a preferred embodiment, the movable element is a membrane enclosed by a membrane housing, the membrane separating the membrane housing into two compartments, the compartments being connected with the fluid line, such that a fluid flowing through the fluid line fills at least one of the compartments and creates the pressure difference across the membrane as a result of which the membrane is set in motion. The valve means may be provided in the membrane and the membrane housing, while the valve means are substantially provided with an opening in the membrane which provides a fluid passage between the two compartments, a membrane valve on the opening in the membrane, and valve control means, such that the valve control means as a result of the movement of the membrane set the membrane valve alternately in the open and the closed position. This preferred embodiment is a reliable and effective embodiment of the invention. Due to the valve means being enclosed by a membrane housing, the chance of leakage of the fluid to an environment is strongly reduced.

The fluid may be the fuel. In that case, according to a further elaboration of the invention, the deactivation means of the at least one burner comprise substantially a pressure equalization line, the pressure equalization line connecting the downstream compartment of the membrane housing with the burner line of the burner, such that when the burner burns, the pressure difference across the membrane is reduced, so that the membrane stops moving. The pressure equalization line can be provided with a buffer tank and a check valve, such that when the membrane valve is in the closed position and fuel is supplied to the burner via the fluid line, the membrane, despite the pressure prevailing in the burner line, can still traverse its stroke completely in that the fuel in the downstream compartment of the membrane housing can flow to the buffer tank. This embodiment of the deactivation means is highly practical, simple and therefore inexpensive.

The fluid can also be a liquid, for instance water. The at least one burner may then be adapted to heat up the liquid by means of a heat exchanger, with the liquid flowing from the heat exchanger to the deactivation means, while the deactivation means comprise substantially temperature-controlled valve means and lines, the temperature-controlled valve means set themselves into a first position as a result of a particular rise of the temperature or at a particular first set value of the temperature of the liquid, the pressure difference across the movable element being reduced via the lines of the deactivation means, such that the movable element stops moving, while the temperature-controlled valve means, through a particular decrease of the temperature or upon a second set value of the temperatures being reached, set themselves into a second position, while the pressure difference across the movable element is increased, such that the movable element is set in motion. Thus that at least one burner can be ignited by allowing a fluid to flow, the fluid in this case not being the fuel. This embodiment of the invention can be used in, for instance, a CH installation or in a hot water for sanitary water.

In every embodiment of the invention, the fuel can be a combustible gas.

Each embodiment of the invention can be provided with more than one burner with associated ignition means. All burners that are provided with such an ignition device can be ignited at the same moment by applying a certain fluid pressure across the movable element. After some time, all or most burners will be ignited. In case of a defective burner, the repetitive ignition will then continue needlessly. That can be stopped by causing the fluid pressure to decrease, such that the movable element of this defective burner stops moving, while the fluid pressure still remains high enough for the other burners to keep burning.

It is noted that U.S. Pat. No. 3,562,562 discloses a device for igniting the burners of a gas cooker, in which a membrane pulsates and with this pulsating action energizes a piezoelectric element; however, the required fluid pressure for energizing the pulsating movement of the membrane is formed by a separate vacuum source which is present especially for this purpose. Maintaining a vacuum in most cases requires a vacuum pump, and hence electricity to drive this pump. In the present invention, by contrast, for the purpose of the ignition, use is made of the flow of a fluid that in any case is to be present already. To be considered here is the fuel that is to be burnt in the main burner, or a medium to be heated with the main burner, such as, for instance, sanitary water.

The invention will be further clarified on the basis of four exemplary embodiments which will be described hereinafter, with reference to the drawing.

Figure 1:
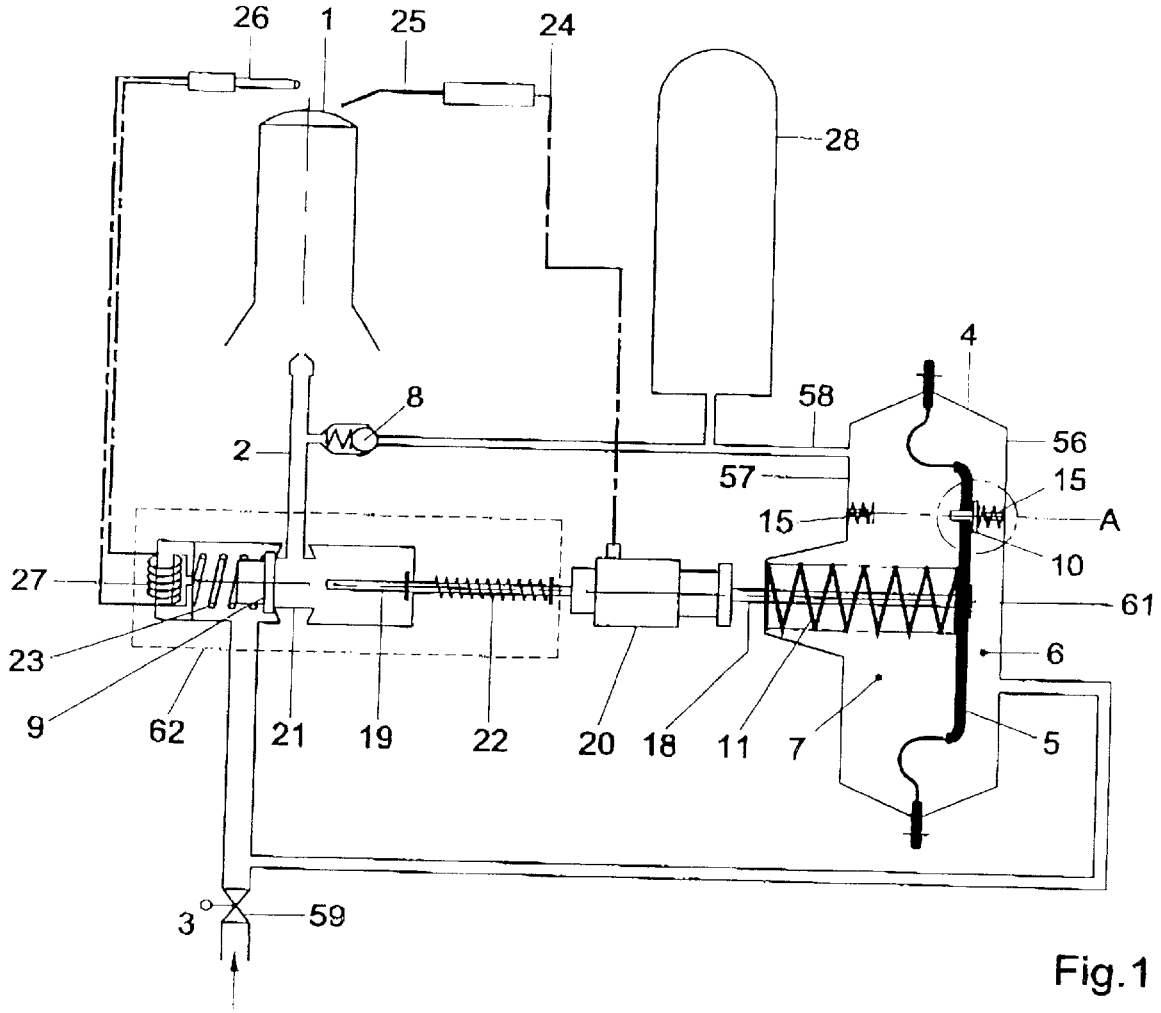
FIG. 1 shows a schematic representation of a first exemplary embodiment of the invention.

In the schematic representation of an exemplary embodiment shown in FIG. 1, the fuel serves as fluid. The fuel can be, for instance, a combustible gas. The exemplary embodiment comprises a burner 1, a burner line 2 and a fluid line 3. Included in the fluid line 3 is a membrane housing 4 provided with a membrane 5 which separates the membrane housing 4 into a first, upstream and a second, downstream compartment 6 and 7, respectively. The first compartment 6 is in communication with a burner line 2 via the fluid line 3 and a valve body 21. The burner line 2 terminates in the burner 1. The second compartment 7 is in communication with the burner line 2 between the valve body 21 and the burner 1 via a pressure equalization line 58. The pressure equalization line 58 in the present exemplary embodiment is provided with a check valve 8 which only allows flow from the second compartment 7 to the burner line 2 and not in the opposite direction. Between the second compartment 7 and the check valve 8 a buffer tank 28 is connected to pressure equalization line 58. The fluid line 3 is provided with a fuel cock 59 which controls the fuel supply to fluid line 3. The membrane 5 is provided with an opening 14 which is closable by a membrane valve 10. Between the membrane housing 4 and the membrane 5 a spring 11 is arranged, such that a spring force at right angles to the membrane 5 is exerted in the direction from a wall 57 of the second, downstream compartment 7 to a wall 56 of the first, upstream compartment 6.

Figure 2:
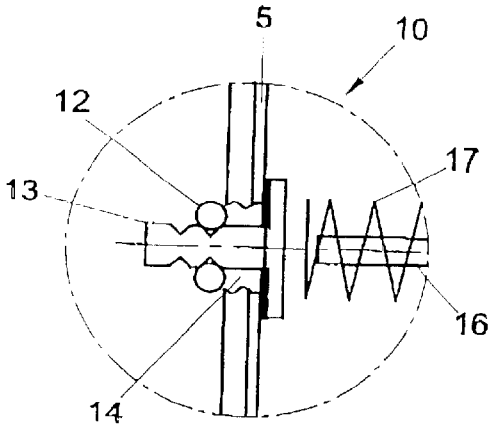
FIG. 2 shows detail A from FIG. 1, with the valve means in a closed position.
Figure 3:
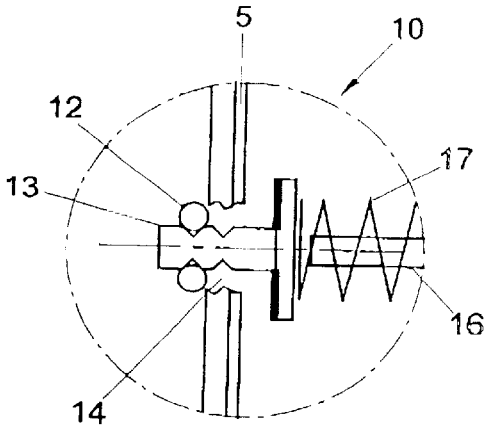
FIG. 3 shows detail A from FIG. 1, with the valve means in an open position.

In FIGS. 2 and 3, the membrane valve 10 is represented in detail. The membrane valve is substantially a valve body 13 provided with a stop spring 12. The stop spring 12 is connected with the membrane 5. FIG. 2 shows the closed position of the membrane valve 10, with the stop spring 12 pressing the valve body 13 against the membrane 5, so that opening 14 is closed. FIG. 3 shows an open position of the membrane valve 10, where the stop spring 12, with the valve body 13, keeps the opening 14 in the membrane 5 opened. The walls 56 and 57 of the membrane housing 4 are provided with valve control means 15, such that the valve control means 15 set the membrane valve 10 in the first or the second position if the membrane is located adjacent the walls referred to. For that purpose, the valve control means 15 are provided with a pressure body 16 and a spring 17.

The membrane 5 is connected to a piezoelectric ignition element 20 through a connecting rod 18. The connecting rod 18 is parallel to a centerline 61 of the membrane housing 4, the centerline extending at right angles to the walls 56 and 57. The piezoelectric ignition element 20 presses on a pressure rod 19 of a standard commercially available thermocouple protection 62. The thermocouple protection 62 is provided with a safety valve 9 in a valve housing 21. On the pressure rod 19 a spring 22 is mounted between the piezoelectric element 20 and the valve housing 21. Between the valve housing 21 and the safety valve 9 there is a safety spring 23 which closes the safety valve 9 against the valve housing 21 in a direction parallel to the centerline 61. The burner line 2 is then closed off from the fluid line 3. The pressure rod 19 extends so far that it does not reach the safety valve 9 if the membrane 5 is near the wall 56 of the membrane housing 4. If the membrane 5 in the membrane housing 4 moves from the wall 56 to the wall 57, the pressure rod 19 extends so far that it pushes the safety valve 9 from its seating in the valve housing 21. In that case, the burner line 2 is in open communication with the fluid line 3.

The piezoelectric ignition element 20 is connected by means of a high-voltage line 24 to an ignition element 25. If the piezoelectric ignition element 20 if forcibly compressed, it generates a high voltage which is transmitted via the high-voltage line 24 to the ignition element 25. The high voltage is discharged by means of an ignition spark between the ignition element 25 and the burner 1.

The safety valve 9 and the safety spring 23 form part of a thermocouple protection, which is further provided with a thermocouple 26 and a coil 27. The thermocouple 26 is mounted such that it generates a thermocouple current if the burner 1 is ignited. The thermocouple 26 is connected to the coil 27, such that the thermocouple current generates a magnetic field by means of coil 27. This magnetic field is such that it exerts an attractive force on the safety valve 9. This attractive force, upon sufficient heating of the thermocouple 26, is stronger than the counteractive spring force of safety spring 23 if the safety valve 9 is open, whereby the gas supply line 2 and the fluid line 3 are in open communication with each other.

The operation of the exemplary embodiment shown in FIG. 1, where the fluid is a combustible gas, proceeds as follows. In a starting situation, the burner 1 is not ignited and the fuel cock 59 is closed, so that no fuel flows through the fluid line 3 yet. This situation is represented in FIG. 1, with the safety valve 9 closed, the membrane 5 disposed by the wall 56 of the membrane housing 4, and the membrane valve 10 closed. The ignition of the burner 1 proceeds automatically by turning on the fuel cock 59. Fuel then flows through the fluid line 3, and hence into the first compartment 6 of the membrane housing 4. The fuel pressure is such that it moves the membrane 5 from the wall 56 to the wall 57 against the spring force of spring 11. During this movement, the membrane 5 pushes the safety valve 9 open via the connecting rod 18, the piezoelectric element and the pressure rod 19. At the moment when the safety valve 9 comes off its seating, fuel flows from the fluid line 3 and the valve housing 21 to the fuel supply line 2, and thus into the burner 1. Check valve 8 prevents fuel from flowing from the burner line 2 via pressure equalization line 58 into the second compartment 7. Thereafter the membrane 5 completes the movement towards the wall 57 in the membrane housing, whereby the piezoelectric element 20 is forcibly compressed between pressure rod 19 and connecting rod 18. This gives rise, in the manner mentioned, to an ignition spark between the ignition electrode 25 and the burner 1, so that the fuel which has flowed into burner 1 can proceed to combustion.

When the membrane 5 reaches the wall 57, the valve control means 15 attached to this wall open the membrane valve 10, with the result that the second compartment 7 is filled with fuel from the first compartment via opening 14. Thus the fuel pressure on the membrane 5 decreases. From a certain moment, the fuel pressure has decreased so far that the spring force of spring 11 on membrane 5 is greater than the force resulting from the fuel pressure. At that moment the membrane 5 moves back from the wall 57 to the wall 56. The pressure rod 19 is thereby moved back too, so that it is no longer able to keep the safety valve 9 open.

If the burner 1, despite an ignition spark from ignition electrode 25, has not been ignited, the safety valve 9 closes as a result of the spring force of the safety spring 23, so that the burner line 2 is again closed off from the fluid line 3. The membrane 5 moves to wall 56 of the membrane housing 4, where the valve control means 15 close the membrane valve 10 again. The fuel which has flowed into the second compartment 7, the buffer tank 28 and the pressure equalization line 58 can flow out via check valve 8 to the fuel line 2. As a result, the fuel pressure on the membrane 5 is increased again, so that the membrane 5 can repeat the movement in the membrane housing 4 as described. The membrane 5 will repeat this movement so long until the burner has been ignited.

If the burner 1 has in effect been ignited, the thermocouple protection can keep the safety valve 9 open in the manner mentioned, so that fuel continues to flow to the burner 1 via the burner line 2. The membrane 5 moves to the wall 56, where the valve control means 15 close the membrane valve 10 again. In this case, no fuel can flow away from the second compartment 7 and buffer tank 28 via the pressure equalization line 58 and check valve 8 because the fuel in the burner line 2 presses the check valve 8 to closure. Thus, after this cycle, or a few more subsequent cycles, of the movement of the membrane 5, the second compartment 7, the buffer tank 28 and the pressure equalization line 58 are filled with fuel. This prevents a pressure difference between the compartments 6 and 7 from being built up again, so that the membrane 5 after this cycle, or a few more subsequent cycles, stops moving.

Figure 4:
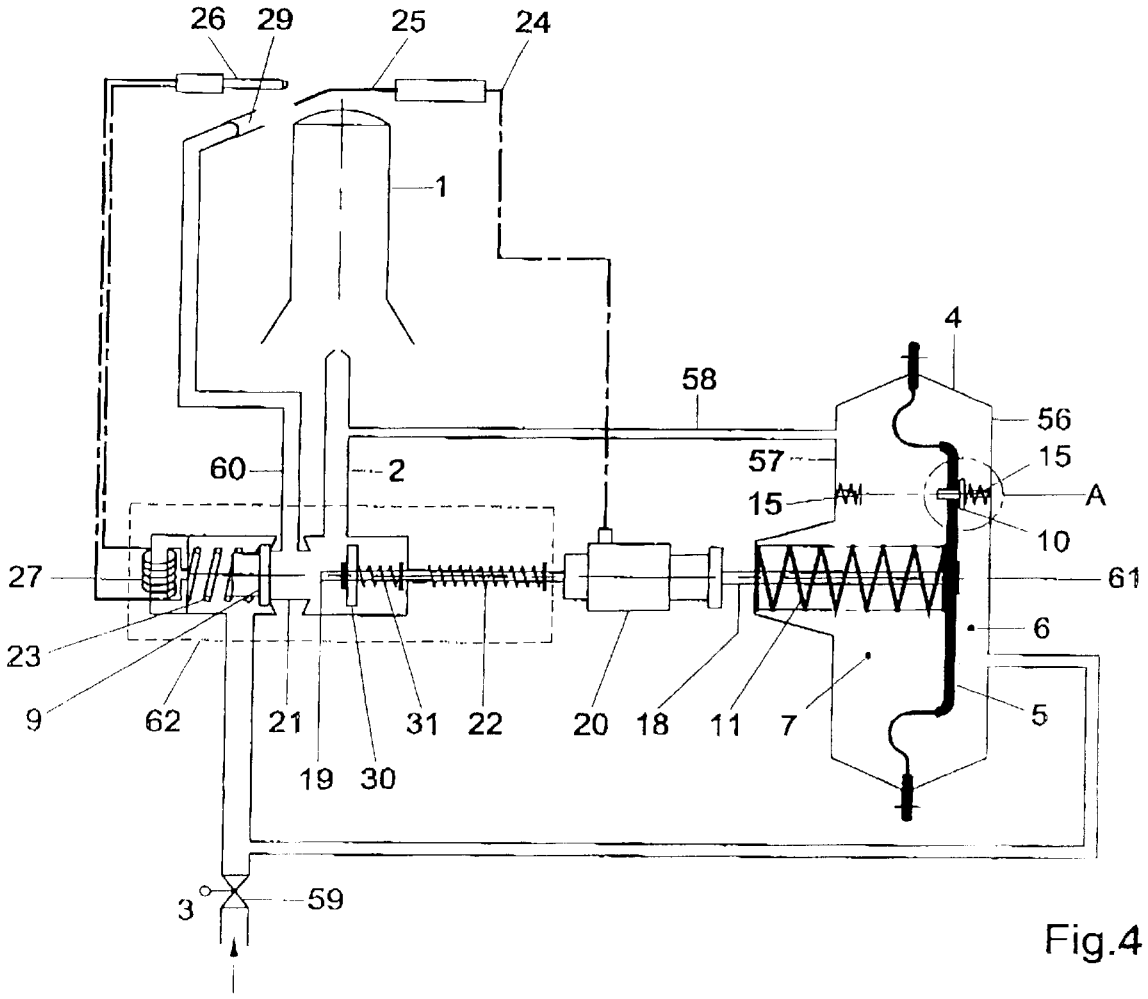
FIG. 4 sows a similar schematic representation to that represented in FIG. 1, of a second exemplary embodiment.

FIG. 4 shows a second exemplary embodiment, in which the ignition means are provided with an ignition burner 29. The ignition burner 29 is connected with the valve housing 21 via a burner line 60. The pressure rod 19 comprises a shutoff valve 30 and a spring 31 within the valve housing 21. Upon the movement of the membrane 5 from wall 56 to wall 57, the pressure rod 19 pushes the shutoff valve 30 onto a seating, so that the burner line 2 of the burner 1 is shut off. Upon a continued movement of the membrane 5, the pressure rod 19 opens the safety valve 9, so that fuel flows from fluid line 3 into the ignition burner 29. In this exemplary embodiment, the ignition electrode 25 and the thermocouple 26 are mounted adjacent the ignition burner 29, such that the ignition electrode 25 can ignite the ignition burner 29, and the thermocouple 26 is heated by an ignited ignition burner 29. The ignition burner 29 is so arranged that it can ignite the burner 1 if fuel flows into burner 1.

The operation of the exemplary embodiment shown in FIG. 4 is based, as in the first exemplary embodiment, on a membrane 5 set in motion by the fuel stream, whereby, as a result of this movement, an ignition spark is generated at the ignition electrode 25. In this case, not the burner 1, but the ignition burner 29 is ignited by the ignition spark produced as a result of the movement of the membrane 5 from wall 56 to wall 57. At that moment, the fuel supply to the burner 1 is closed off by shutoff valve 30. Subsequently, after the valve control means 15 of the wall 57 have set the membrane valve 10 in the open position, the membrane 5 moves from wall 57 to wall 56. As a result, pressure rod 19 dislodges the shutoff valve 30 from its seating in the valve housing 21. If the thermocouple protection, with an ignition burner ignited, keeps the safety valve 9 open, fuel can flow into the fuel supply line 2 of the burner 1. Thereafter, this fuel is ignited by the burning ignition burner 29. In this exemplary embodiment, the check valve 8 and the buffer tank 28 are superfluous, and the burner line 2 can be connected directly to the second compartment 7 via pressure equalization line 58. This connection guarantees that if the burner 1 is burning, the pressure difference across the membrane 5 is reduced, such that the membrane 5 stops moving.

Figure 5:
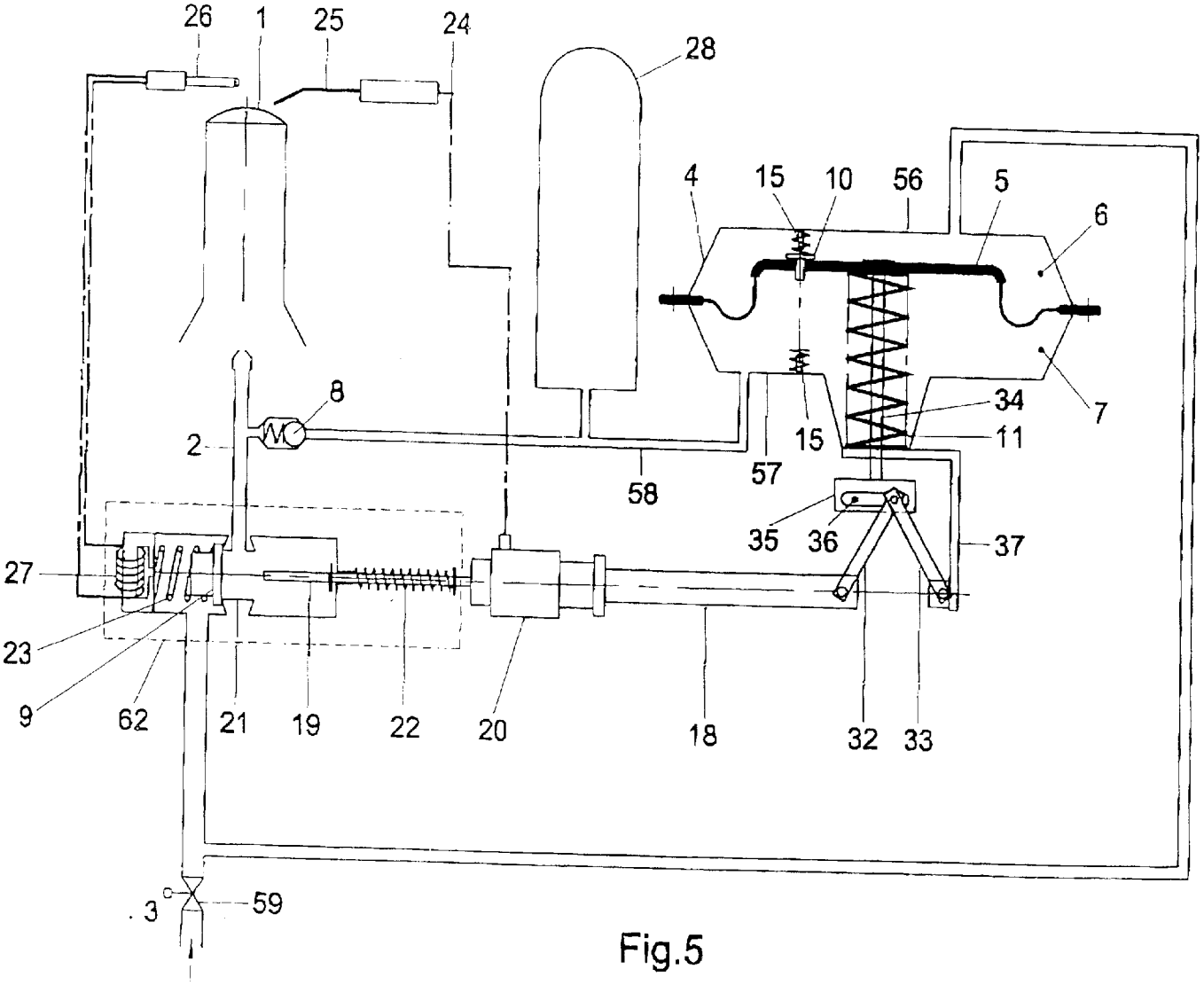
FIG. 5 shows a similar schematic representation to that represented in FIG. 1, of a third exemplary embodiment.

In FIG. 5 a third exemplary embodiment is represented. This exemplary embodiment differs from the first exemplary embodiment in the transmission of the movement of the membrane 5 onto the connecting rod 18. In this exemplary embodiment, this transmission is effected by two rods 32, 33 and a transmission rod 34, the transmission rod 34 being connected to the membrane 5 and extending from the membrane housing 4 in a direction at right angles to the connecting rod 18. The transmission rod 34 is provided, at the end outside the membrane housing 4, with a head 35, which comprises a slot 36 extending parallel to the connecting rod 18. The two rods 32 and 33 at one end are pivotally connected to each other in the slot 36. The other end of rod 33 is pivotally connected to an L-shaped plate 37, the pivotal point being located in line with connecting rod 18. The other end of rod 34 is pivotally connected with the connecting rod 18. In this so-called toggle joint lever transmission, the first part of the movement of the membrane from wall 56 to wall 57 results in an enlarged movement of connecting rod 18. As a consequence, safety valve 9 can be pushed off its seating via pressure rod 19. Thereafter the second part of the movement of the membrane 5 from wall 56 to wall 57 provides for the compression of the piezoelectric element 20. That requires force, which can be accomplished better by this toggle joint lever transmission than by the direct transmission connection as employed in the first exemplary embodiment.

Figure 6:
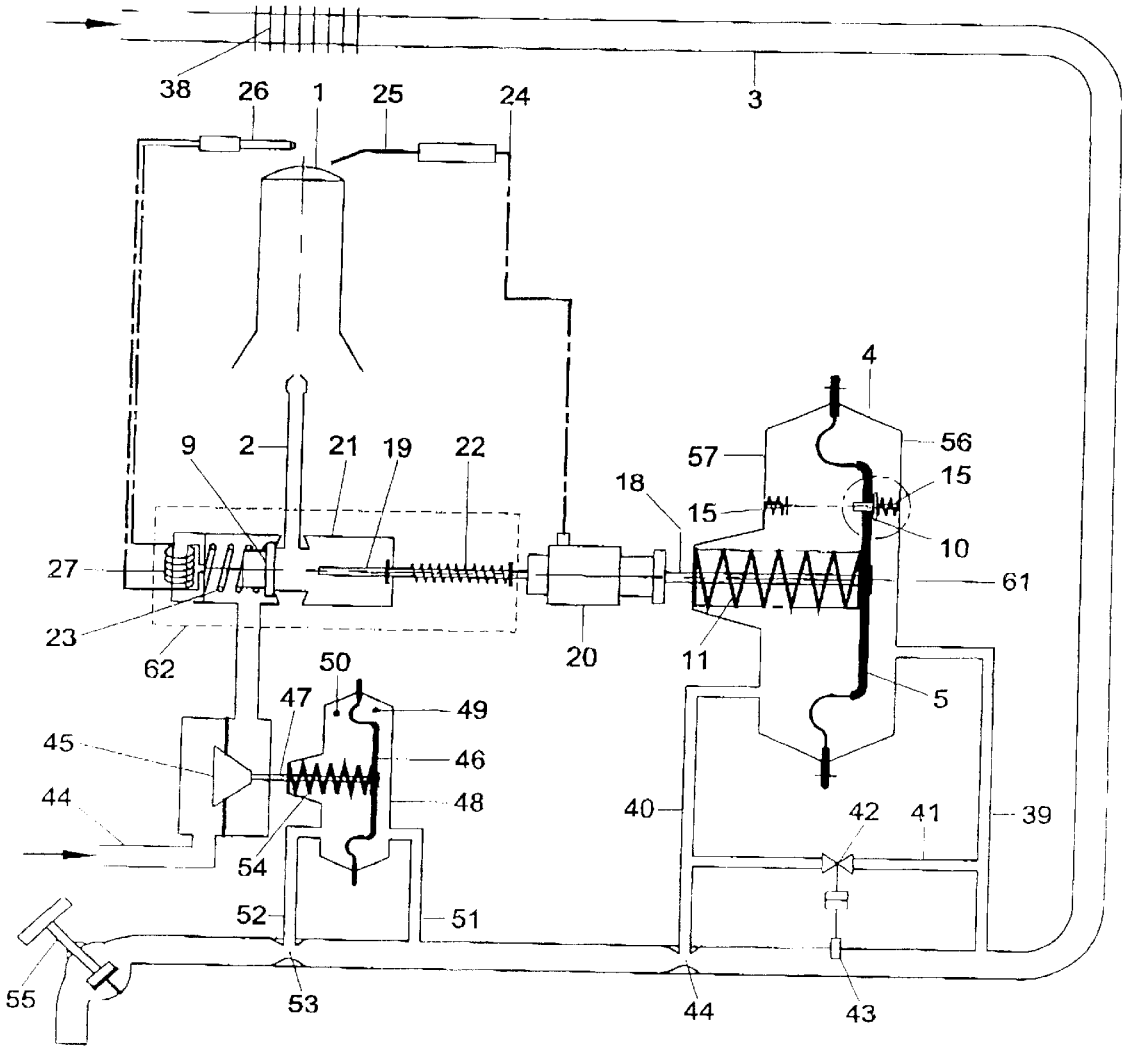
FIG. 6 shows a similar schematic representation to that shown in FIG. 1, of a fourth exemplary embodiment.

In the exemplary embodiment shown in FIG. 6, fluid and fuel are separated from each other. The fuel can be, for instance, natural gas, and the fluid can be, for instance, mains water. The burner 1 is so arranged that, when ignited, it heats the fluid flowing in the fluid line 3 via a heat exchanger 38. The first and second compartment 6 and 7, respectively, are connected to the fluid line 3 by respective lines 39 and 40. Lines 39 and 40, bypassing the membrane housing, are connected by a bypass line 41, provided with a valve 42. Valve 42 is controlled by a temperature sensor 43 which measures the temperature of the fluid flowing in the fluid line 3. The control of the valve 42 is such that at a first set value of the temperature or upon a particular temperature rise of the fluid, the valve 42 opens, and at a second set value of the temperature or upon a particular temperature decrease of the fluid, the valve 42 closes. In the fluid line 3 a venturi 44 is provided at the junction with the line 40. Fuel line 44 is provided with a valve 45 which is connected with a membrane 46 via connecting rod 47. The membrane 46 divides a membrane housing 48 into two compartments 49 and 50, the first compartment 49 being connected with the fluid line 3 via line 51, and the second compartment being connected with the fluid line 3 through line 52. The junction between fluid line 3 and line 52 is provided with a venturi 53. A spring 54 is included between the membrane 46 and the membrane housing 48, such that the spring force moves the membrane 46 in a direction where the membrane 46 closes the valve 45 via connecting rod 47. In the fluid line 3 a fluid cock 55 is included.

The operation of the fourth exemplary embodiment proceeds as follows. The starting situation is represented in FIG. 6, where the fluid cock 55 is closed, so that the fluid does not flow. The safety valve 9 and the valve 45 are closed, and the membrane 5 is disposed by wall 56. The ignition of the burner 1 starts automatically when the fluid cock 55 is opened. At that moment, the fluid starts to flow into the fluid line 3 as a result of a fluid pressure of the fluid. This flow causes, via the lines 51 and 52, a pressure difference in the membrane housing 48 between the first compartment 49 and the second compartment 50. The fluid pressure is such that the force on the membrane 46 as a result of the fluid pressure is greater than the spring force of spring 54. As a result, the membrane 46 moves such that it opens the valve 45 and thus opens the fuel line 44. If the temperature of the fluid is relatively low, the bypass line 41 will be closed off by valve 42. As a result, the flow of the fluid via the lines 39 and 40 causes a pressure difference across the membrane 5, so that the ignition cycle of the ignition means described in relation to the first exemplary embodiment begins. The fluid pressure must then be such as to exert on the membrane 5 a force which is greater than the counteractive spring force of spring 11.

If the ignition has proceeded successfully, the fluid in the heat exchanger 38 is heated by the burner 1. When reaching a first set value of the temperature of the fluid, the temperature sensor 43 will open the valve 42 at a particular time. As a result, the pressure difference across the membrane 5 is reduced, such that the membrane stops moving. The burner 1 meanwhile continues to burn because the fuel supply to the burner 1 remains opened via the valve 45 and safety valve 9 being held open. The burner 1 is switched off by turning off the fluid cock 55. As a result, the fluid flow stops and the fuel supply to the burner 1 is closed off by the valve 45 falling shut.

Each of the four exemplary embodiments discussed can be provided with more than one burner 1 with associated ignition means. All burners 1 can be ignited by placing the associated membranes 5 under a certain fluid pressure. After some time, all or most burners 1 will have been ignited. In case of a defective burner 1, the ignition cycle described will continue needlessly. This can be stopped by decreasing the fluid pressure, such that the membrane 5 of this defective burner 1 stops moving, while the other burners continue to burn.

It is clear that the invention is not limited to the exemplary embodiments described, but that various modifications are possible within the framework of the invention.

The fuel can be any fluid fuel, both in gas and in liquid form. The fluid can be any fluid substance, for instance a gas or gas mixture, such as natural gas, air, or a liquid, for instance, a liquid fuel, water, or a gas-liquid mixture.

For one skilled in the art, it will be clear that valves 8, 9, 10, 30, 42, 45 and 5 can be fitted in different ways. Further, it will be clear that the springs 11, 12, 16, 22, 23 and 54 can be designed in different forms and types. The valve control means 15 can be fitted on the membrane housing 4 or on membrane 5. In the latter case, instead of a membrane valve 10 a similar valve will have to be arranged in the membrane housing 4.

The reduction of the pressure difference across the membrane 5 can be effected in different ways, for instance by means of the method described in the exemplary embodiments, with a membrane valve 10 and valve control means 15, or through valve means and bypass lines which are situated outside the membrane housing 4 and control the pressure difference across the membrane 5 with respect to the position and/or movement of the membrane 5, or with other means and/or methods. The membrane 5 is then not provided with a membrane valve 10.

The invention does not limit the form and/or type of movable element 5 that is used to convert a pressure difference of a fluid into a movement, to a membrane 5 in a membrane housing 4. Instead of the membrane 5, a piston could be employed which is slidably arranged in a cylinder housing which, for that matter, has the same function as the membrane housing 4. Then, in a similar manner to that described for the membrane 5, valve means may be provided which effect a reciprocating movement of the piston in the cylinder. The movement of the piston, in a similar manner to that described in relation to the membrane, is used for energizing a spark-generating element, such as, for instance, a piezoelectric element. Many other movable elements are conceivable, for instance balloons, a compartment with at least one stretchable wall, or other means that move as a result of a fluid pressure.

Furnishing an ignition temperature can be realized in a variety of ways, for instance with the method described using a piezoelectric element 20, or with a flint with friction wheel, a power generator or other means that may serve this purpose.

The protection that closes off the gas supply line 2 to the burner 1 if combustion stops is not requisite within the framework of the invention. However, in the framework of a safe operation of the burner 1, such a provision is recommendable. It can be a thermocouple protection 62, provided with a thermocouple 26, as in the exemplary embodiments, or a protection provided with an infrared sensor, a bimetal, or a temperature-sensitive resistor, or any other conceivable means that measures whether in the burner 1 a flame is present and, depending on the result of that measurement, controls the fuel supply to the burner 1.

The piezoelectric element 20, instead of being arranged in one line with pressure rod 19, can also be arranged parallel thereto, while the membrane or piston movement operates both elements simultaneously, optionally via a transmission.

The fluid lines and fuel lines can be manufactured in all conceivable forms and from all possible materials.

It is noted that the term burner in connection with this invention should be interpreted broadly. Thus, an ignition space of a scarecrow cannon in which periodically an amount of combustible gas is caused to explode can also be regarded as a burner within the meaning of the present invention. In that case, the ignition mechanism is used to effect the explosion periodically.

What is claimed is:

1. A device for igniting fuel, comprising at least one burner and an ignition means, said ignition means comprising an ignition element, a movable element connected to a fluid line, such that when a fluid contained in said fluid line flows, creates a pressure difference across said movable element, as a result of which said movable element is set in motion, said movable element being connected with said ignition element, such that the movement of said movable element generates, via said ignition element, an ignition temperature through which the fuel is caused to combust, said fluid line being a fuel line for the purpose of the supply of fuel to said at least one burner, said ignition means igniting said burner without the need for external electric energy.

2. A device according to claim 1, characterized in that said ignition means comprise valve means and spring means which exert an oppositely directed spring force on the movable element with respect to the force as a result of said pressure difference, while in an opened position of said valve means the pressure difference across said movable element is smaller than in a closed position, while in said closed position said spring force is smaller than said force as a result of the pressure difference, while in the opened position of said valve means said spring force is greater than said force as a result of the pressure difference, such that upon a periodic alternation of said position of the valve means between said open and said closed position, the movement of said movable element repeats itself.

3. A device according to claim 2, characterized in that said movable element is a membrane enclosed by a membrane housing, the membrane separating the membrane housing into two compartments, said compartments being connected with a fluid line, such that a fluid flowing through said fluid line fills at least one of said compartments and creates the pressure difference across said membrane as a result of which said membrane is set in motion.

4. A device according to claim 3, characterized in that said valve means are provided in said membrane and said membrane housing, wherein said valve means are substantially provided with an opening in said membrane which provides a fluid passage between said two compartments, a membrane valve on said opening in said membrane, and valve control means, such that said valve control means as a result of the movement of said membrane set said membrane valve alternately in said opened and said closed position.

5. A device according to claim 1, characterized in that the fluid is the fuel.

6. A device according to claim 5, characterized in that the fuel in a combustible gas.

7. A device according to claim 3, characterized in that the deactivation means of said at least one burner comprise substantially a pressure equalization line, said pressure equalization line connecting a downstream compartment of said membrane housing with a burner line of said burner, such that when said burner burns, the pressure difference across said membrane is reduced, so that said membrane stops moving.

8. A device according to claim 1, characterized in that said at least one burner comprises deactivation means which, when said fuel has been ignited or burns, reduce the pressure difference of the fluid across said movable element, such that said movable element stops moving.

9. A device according to claim 1, characterized in that said at least one burner is provided with a protection which, as a result of a termination of the combustion, shuts off a burner line by means of closing means, such that no fuel flows into said at least one burner, the protection being coupled to said ignition means, such that closure of said burner line is accompanied by the creation of a pressure difference across said movable element as a result of which said movable element is set in motion.

10. A device according to claim 9, characterized in that said movable element is coupled to said closing means, such that as a result of the movement of said movable element said closing means are opened when the movement of said movable element generates the ignition temperature via said ignition element, so that fuel flows into said at least one burner.

11. A device according to claim 9, characterized in that said closing means, as a result of a termination of the combustion in said burner, also shut off a burner line of said ignition burner.

12. A device according to claim 11, characterized in that said movable element is coupled to said closing means, such that as a result of the movement of said movable element said burner line of an ignition burner is opened when the movement of said movable element generates the ignition temperature via said ignition element (20), so that fuel flows into said ignition burner, whereafter, as a result of the movement of said movable element said burner line of said burner (1) is opened, so that fuel flows into said burner, such that said ignited ignition burner causes the fuel in said burner to combust.

13. A device according to claim 1, characterized in that said ignition means comprise an ignition burner.

* * * * *

UNITED STATES PATENT AND TRADEMARK OFFICE

CERTIFICATE OF CORRECTION

PATENT NO. : 6,517,342 B2
DATED : February 11, 2003
INVENTOR(S) : Geuko van der Veen It is certified that error appears in the above-identified patent and that said Letters Patent is hereby corrected as shown below:

Column 2,
Line 34, "It is therefor recommended" should read -- It is recommended --; and Column 4,
Line 44, insert the following:

-- DETAILED DESCRIPTION OF THE INVENTION --.

Signed and Sealed this

Twentieth Day of January, 2004

JON W. DUDAS
*Acting Director of the United States Patent and Trademark Office*